US007700503B2

(12) United States Patent
Thomas, Jr.

(10) Patent No.: US 7,700,503 B2
(45) **Date of Patent: *Apr. 20, 2010**

(54) LAYERED BALLISTIC-RESISTANT MATERIAL

(75) Inventor: Howard L. Thomas, Jr., Auburn, AL (US)

(73) Assignee: Auburn University, Auburn, AL (US)

( * ) Notice: Subject to any disclaimer, the term of this patent is extended or adjusted under 35 U.S.C. 154(b) by 0 days.

This patent is subject to a terminal disclaimer.

(21) Appl. No.: 10/876,804

(22) Filed: Jun. 25, 2004

(65) Prior Publication Data

US 2009/0291605 A1 Nov. 26, 2009

Related U.S. Application Data

(60) Provisional application No. 60/482,962, filed on Jun. 27, 2003, provisional application No. 60/499,603, filed on Sep. 2, 2003.

(51) Int. Cl.
*B32B 5/26* (2006.01)
*B32B 5/06* (2006.01)

(52) U.S. Cl. ..... 442/134; 442/135; 442/268; 442/270; 442/271; 442/272; 442/320; 442/324; 442/326; 442/381; 442/387; 442/389; 442/392; 428/911; 89/36.01; 89/36.02; 89/36.05; 2/2.5

(58) Field of Classification Search ..... 442/134, 442/135, 268, 270, 271, 272, 320, 324, 326, 442/381, 387, 389, 392; 428/911; 2/2.5; 89/36.01, 36.02, 36.05
See application file for complete search history.

(56) References Cited

U.S. PATENT DOCUMENTS

| | | | |
|---|---|---|---|
| 3,320,619 | A | 5/1967 | Lastnik et al. |
| 3,392,406 | A | 7/1968 | Pernini et al. |
| 3,563,836 | A | 2/1971 | Dunbar |
| 4,483,020 | A | 11/1984 | Dunn |
| 4,660,223 | A | 4/1987 | Fritch |
| 4,681,792 | A | 7/1987 | Harpell et al. |
| 4,737,402 | A | 4/1988 | Harpell et al. |
| 4,879,165 | A | 11/1989 | Smith |

(Continued)

FOREIGN PATENT DOCUMENTS

| | | | |
|---|---|---|---|
| DE | 68181 | | 7/1892 |
| EP | 0323763 | | 7/1989 |
| EP | 0 499 812 | A1 | 8/1992 |
| FR | 469915 | | 8/1914 |
| FR | 1119291 | | 6/1956 |
| GB | 2302669 | A * | 1/1997 |
| WO | WO 93/04336 | | 3/1993 |
| WO | WO 02/103275 | A2 | 12/2002 |

OTHER PUBLICATIONS

Analysis of Three-Dimensional Textile Preforms for Multidirectional Reinforcement of Composites, Guang-Wu Du, Tsu-Wei Chou, Journal of Materials Science 26, pp. 3438-3448, 1991.

(Continued)

*Primary Examiner*—Ula C Ruddock
(74) *Attorney, Agent, or Firm*—Haverstock & Owens LLP

(57) ABSTRACT

A ballistic-resistant material having a first exterior layer formed of a ballistic-resistant non-woven textile, a second exterior layer formed of a ballistic-resistant non-woven textile, and an interior layer of ballistic-resistant woven textile arranged between the first exterior layer and the second exterior layer. The woven textile is a tight weave. The woven layer a high occupation, high fabric density woven textile at or near the technical jamming point of fabric construction. Also disclosed are articles made from the ballistic-resistant material.

24 Claims, 11 Drawing Sheets

U.S. PATENT DOCUMENTS

| | | | | | |
|---|---|---|---|---|---|
| 4,892,780 | A | | 1/1990 | Cochran et al. | |
| 5,026,603 | A | | 6/1991 | Rodini | |
| 5,102,723 | A | | 4/1992 | Pepin | |
| 5,104,726 | A | * | 4/1992 | Ross | 442/207 |
| 5,173,138 | A | | 12/1992 | Blauch et al. | |
| 5,187,003 | A | | 2/1993 | Chitrangad | |
| 5,190,802 | A | | 3/1993 | Pilato | |
| 5,256,429 | A | * | 10/1993 | Honda et al. | 442/189 |
| 5,312,693 | A | | 5/1994 | Paul | |
| 5,343,796 | A | | 9/1994 | Cordova et al. | |
| 5,591,933 | A | | 1/1997 | Li et al. | |
| 5,622,771 | A | | 4/1997 | Chiou et al. | 428/219 |
| 5,660,913 | A | | 8/1997 | Coppage, Jr. | |
| 5,724,670 | A | * | 3/1998 | Price | 2/2.5 |
| 5,736,474 | A | | 4/1998 | Thomas | |
| 5,989,375 | A | | 11/1999 | Bortz | |
| 6,119,575 | A | | 9/2000 | Dragone et al. | |
| 6,162,746 | A | * | 12/2000 | Chiou | 442/134 |
| 2003/0022583 | A1 | | 1/2003 | Thomas et al. | |
| 2004/0132368 | A1 | * | 7/2004 | Price et al. | 442/247 |
| 2004/0144244 | A1 | * | 7/2004 | Sargent | 89/36.02 |

OTHER PUBLICATIONS

Definition of JAMMED, Online Textile Dictionary, ww.resil.com., 2009.

Billmeyer, Jr., Fred W., "Textbook of Polymer Science," Third Edition, 1994, pp. 366, 367, 410 and 411.

Rose et al., "The Condensed Chemical Dictionary," 1961, p. 819, 911, 912, and 1133.

"Introduction to Polymer Chemistry," McGraw-Hill, Inc., 1971, pp. 8-9.

Joseph, Marjory, L., "Introduction to Textile Science," Holt, Rinehart and Winston, Fifth Edition, 1986, pp. 258-259.

Thomas, Jr., et al., "Characteristics and Performance of Needlepunched Flexible Ballistic Personal Protection Fabric Constructed from High Performance Fibers," Institute of Textile Technology, pp. 2-9.

"Enhanced Lightweight Explosive and Fragmentation Protection for Battlefield and Emergency Structures and Combat Vehicles," Auburn University.

* cited by examiner

LAYERED BALLISTIC-RESISTANT MATERIAL

CROSS-REFERENCE TO RELATED APPLICATIONS

This application claims priority to U.S. Provisional Application No. 60/482,962, filed Jun. 27, 2003, and U.S. Provisional Application No. 60/499,603, filed Sep. 2, 2003, both of which are hereby incorporated by reference in their entireties.

FIELD OF THE INVENTION

The present invention relates generally to protective garments and equipment and, more particularly, to a layered material constructed of an inner layer of a woven material arranged between outer layers of non-woven materials.

BACKGROUND OF THE INVENTION

Garments and equipment fabricated from ballistic resistant materials, sometimes referred to as "bullet-proof" materials, serve to protect against penetration by a bullet or other ballistic object.

Despite a number of advances in the field, needs still exist for improvements in ballistic-resistant materials. It is to the provision of improved ballistic-resistant materials, and to garments (vests, helmets, body armor and the like) and equipment (shielding, coverings, shrouds, etc.) made of such materials, that the present invention is primarily directed.

SUMMARY OF THE INVENTION

The present invention provides improved ballistic-resistant materials and garments (vests, helmets, body armor and the like) and equipment (shielding, coverings, shrouds, etc.) made of such materials.

In one aspect, the present invention provides a ballistic-resistant material comprising a first exterior layer formed of a first ballistic-resistant non-woven textile, a second exterior layer formed of a second ballistic-resistant non-woven textile, and an interior layer of ballistic-resistant woven textile arranged between the first exterior layer and the second exterior layer. The woven textile is a tight weave. The woven textile is a high occupation, high fabric density woven textile at or near the technical jamming point of fabric construction. Loose weaves such as baskets, plisses, and variable multiple designs within the repeat pattern are not of benefit in this material.

In another aspect, a material of the invention further comprises a layer of filament wrap, resin-reinforced textile arranged between the first exterior layer and the second exterior layer.

In another aspect, the invention includes a layered ballistic-resistant material from which air has been removed from the non-woven layer(s).

In a further aspect, the invention provides articles made from the layered ballistic-resistant material.

These and other aspects, features and advantages of the invention will be understood with reference to the drawing figures and detailed description herein, and will be realized by means of the various elements and combinations particularly pointed out in the appended claims. It is to be understood that both the foregoing general description and the following brief description of the drawings and detailed description of the invention are exemplary and explanatory of preferred embodiments of the invention, and are not restrictive of the invention, as claimed.

BRIEF DESCRIPTION OF THE DRAWING FIGURES

DESCRIPTION OF PREFERRED EMBODIMENTS

Figure 2:
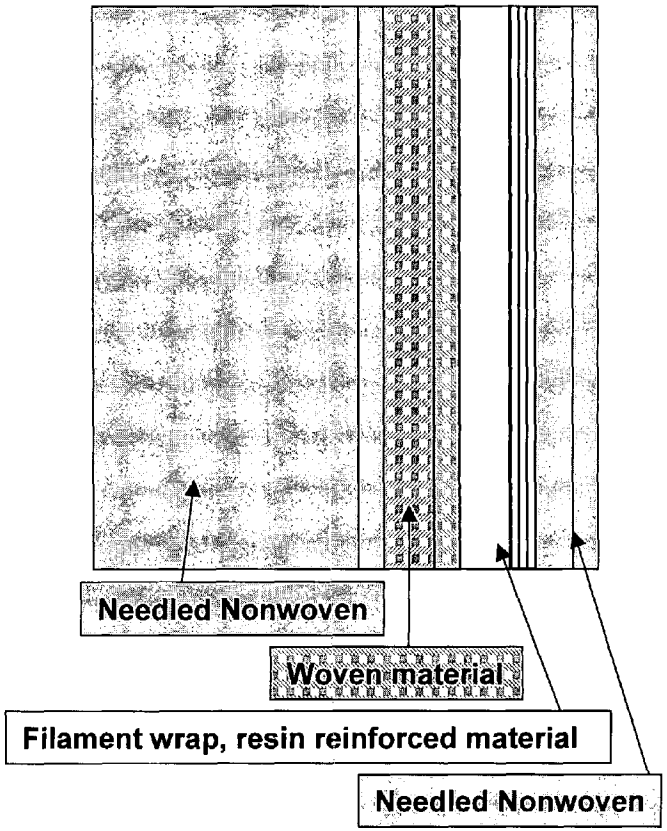
FIG. 2 shows a layered ballistic-resistant material according to a second example embodiment of the present invention.
Figure 1:
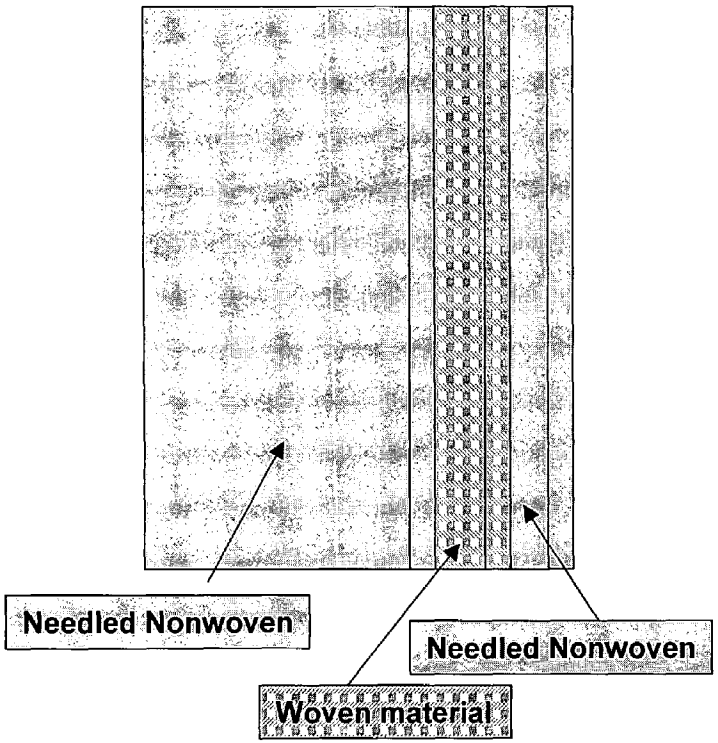
FIG. 1 shows a layered ballistic-resistant material according to a first example embodiment of the present invention.
Figure 4:
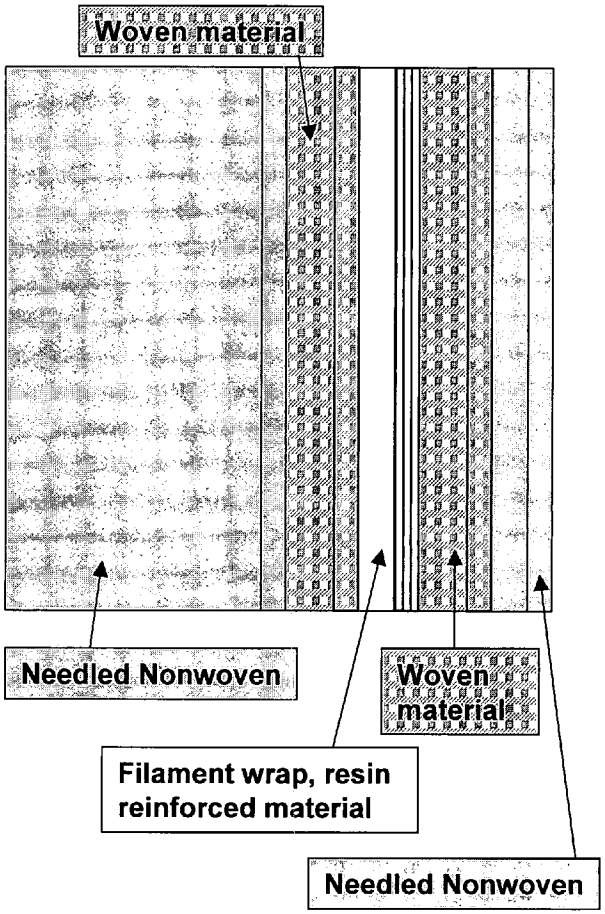
FIG. 4 shows a layered ballistic-resistant material according to a fourth example embodiment of the present invention.
Figure 3:
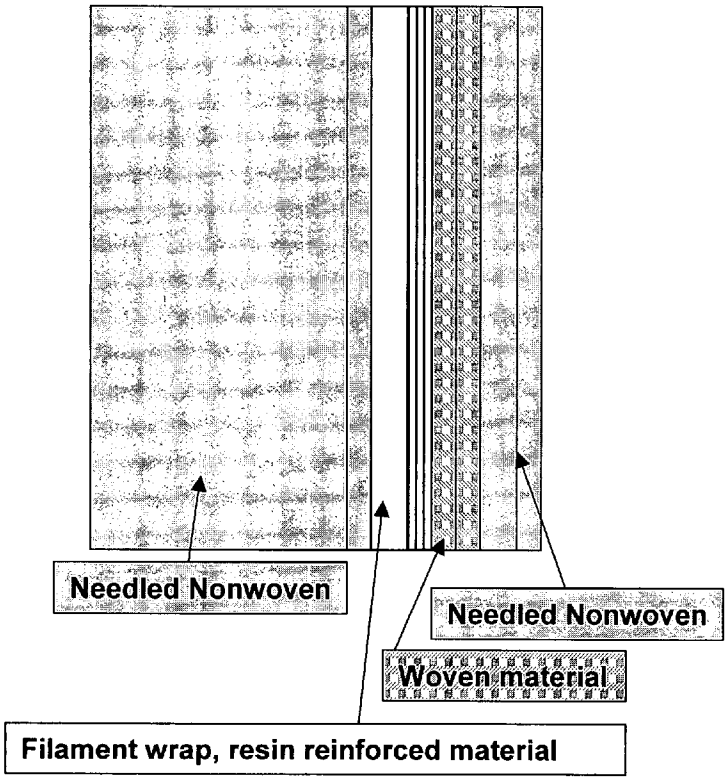
FIG. 3 shows a layered ballistic-resistant material according to a third example embodiment of the present invention.
Figure 5:
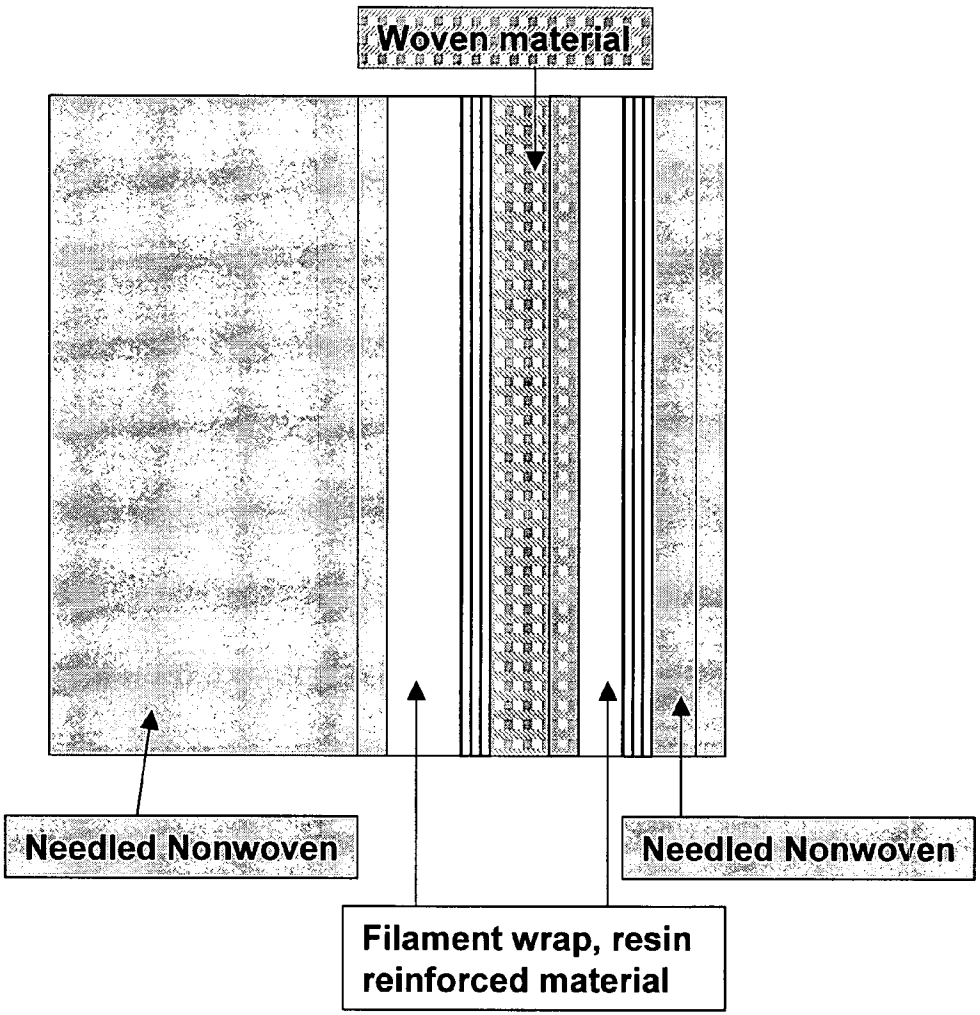
FIG. 5 shows a layered ballistic-resistant material according to a fifth example embodiment of the present invention.
Figure 6:
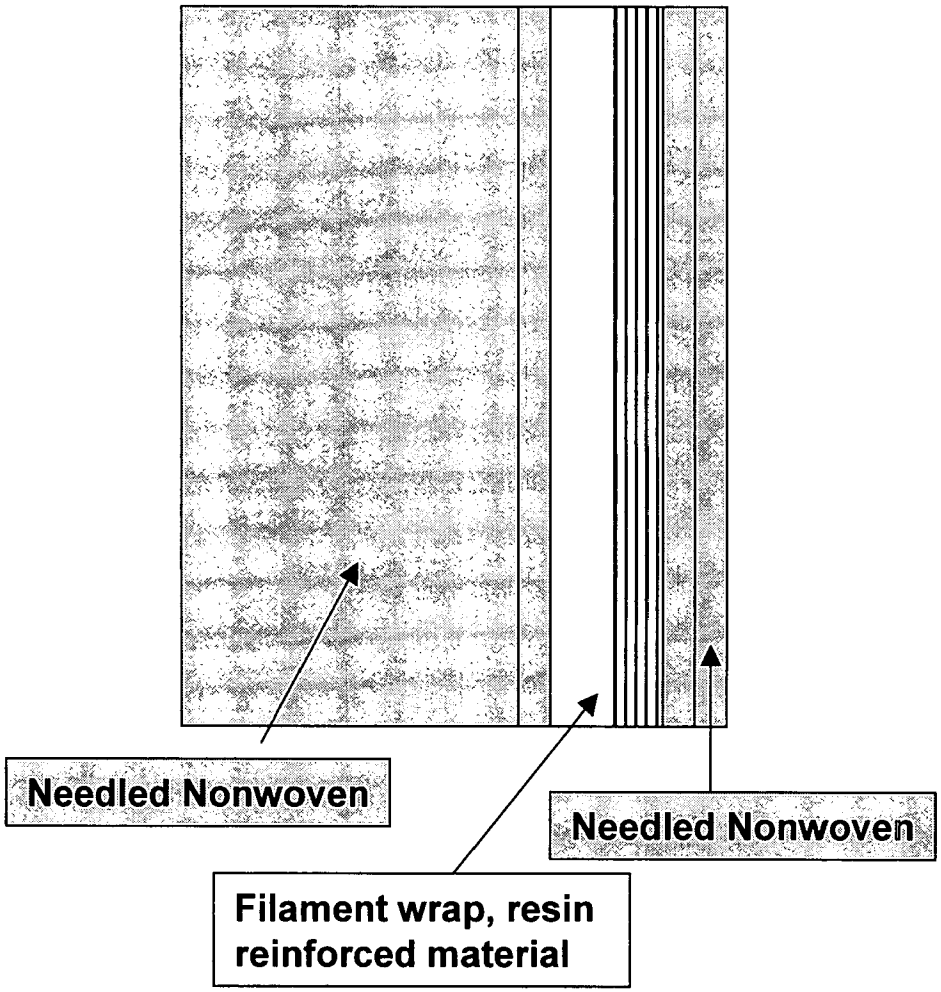
FIG. 6 shows a layered ballistic-resistant material according to a sixth example embodiment of the present invention.

The present invention may be understood more readily by reference to the following detailed description of the invention taken in connection with the accompanying drawing figures, which form a part of this disclosure. It is to be understood that this invention is not limited to the specific devices, methods, conditions or parameters described and/or shown herein, and that the terminology used herein is for the purpose of describing particular embodiments by way of example only and is not intended to be limiting of the claimed invention.

Also, as used in the specification including the appended claims, the singular forms "a," "an," and "the" include the plural, and reference to a particular numerical value includes at least that particular value, unless the context clearly dictates otherwise.

Ranges may be expressed herein as from "about" or "approximately" one particular value and/or to "about" or "approximately" another particular value. When such a range is expressed, another embodiment includes from the one particular value and/or to the other particular value. Similarly, when values are expressed as approximations, by use of the antecedent "about," it will be understood that the particular value forms another embodiment.

As used herein "ballistic-resistant" is used to indicate that the described material removes some amount of energy from a ballistic projectile when the projectile encounters the material. The term is relative and does not indicate a particular level of resistance, for example, one material or multiple layers of a material can be "more ballistic resistant" than another material or a single layer of material.

As used herein "textile" is used to indicate a pliable material made usually by weaving, needlepunching, or knitting natural or synthetic fibers and filaments and includes non-woven materials.

FIGS. 1-6 show various embodiments of a layered ballistic-resistant material according to the present invention.

The order of layering of materials used in a multi-component architecture of ballistic resistant materials has been found to significantly affect the performance of the total material structure. Experimental results (see e.g., EXAMPLES) using combinations of textiles known and commercially available in the field demonstrate the effect of the order (sequence) of the layers on the performance results. These results demonstrate that the specific layered construction of the present invention is superior to previous materials, specifically, a non-woven/woven/non-woven structure has been found to be very effective.

The invention includes a multilayered ballistic-resistant material comprising a) a first exterior layer of a first ballistic-resistant non-woven textile, b) a second exterior layer of a second ballistic-resistant non-woven textile, and c) an interior layer of a ballistic-resistant woven textile arranged between the first exterior layer and the second exterior layer, wherein the woven textile is a tight weave, specifically a high occupation, high fabric density woven textile at or near the technical jamming point of fabric construction.

Exterior Layers

Non-Woven Textile

The first and second exterior layers of the ballistic-resistant material comprise a first and second non-woven textile, respectively. The first and second layers can comprise the same non-woven textile or different non-woven textiles.

The first and second non-woven textiles are ballistic resistant.

A preferred non-woven textile for the first and second layers is felt, particularly needled felt. A needled nonwoven is any of a number of nonwoven materials, for example, those produced by the processes of carding, air laying, randomizer roll, crosslapping, lot merge and/or slurrying techniques, which are then bonded together by needlepunching entanglement of fibers as a primary consolidation method. The resulting textile can be resin encapsulated, adhesive bonded, thermally bonded, and/or laminated, but the preferred embodiment is needlepunched with no subsequent consolidation techniques applied afterward.

Materials which can be used as the non-woven include, for example, ArmorFelt® (50% para-aramid, 50% extended chain polyethylene (ECPE)) (Plainsman Armor International, Inc., Auburn, Ala.), 100% Kevlar®, 100% Twaron®, 100% Dyneema® Fraglight, 100% Spectra®, 100% Zylon®, and blends of them and other fibers (see below). The preferred fiber types for the non-woven textile are those that are high modulus, high tensile strength fibers. Example fibers and example commercial products (where applicable) are listed, without limitation, below. Blends or mixtures of the fibers can be used. One of skill in the art can determine a particular non-woven textile and component fiber to use for a particular application.

The first layer can comprise more than one layer of non-woven textile, as illustrated in the Figs. One of skill in the art can determine the number of layers of non-woven textile to use for a particular application.

The second layer can comprise more than one layer of non-woven textile, as illustrated in the Figs. One of skill in the art can determine the number of layers of non-woven textile to use for a particular application.

Interior Layer(s)

Woven Textile

The interior layer(s) of the ballistic-resistant material can comprise a woven textile. A woven material is any of a number of fiber-containing materials, for example, those produced by the processes of staple fiber or filament assembly into yarns, consolidation of yarns into assemblies for weft insertion and organization of yarns into assemblies for warps, suitable for manipulation into a set of warp and weft interlacings that form the assemblies into a useful structure. The processes can, but do not have to, include opening, carding, drawing, combing, roving, spinning, winding, warping, sizing and weaving. Structures such as flat goods, multiaxial, pile, and three-dimensional weaves are included in this category. This general category can also include the processes of braiding, which are mechanically composed of the same types of structural interlacing as found in conventional woven materials. The resulting textile can be resin encapsulated, adhesive bonded, thermally bonded, and/or laminated, but a preferred embodiment is in the woven state with no subsequent consolidation or reinforcement techniques applied afterward.

The woven textile in an interior layer is not a loosely woven textile. The woven textile is not one which will be highly deformable upon impact. Some minimal deformation can be acceptable upon impact, however.

The woven textile is preferably woven in plain weave, twill, or satin weave patterns. The preferred woven textiles are high occupation, high fabric density woven textiles at or near the technical jamming point of fabric construction. Loose, highly deformable woven textile structures are not of benefit in the designs. The central core can also further comprise a knit, a shield, etc.; alternatively, the woven can be substituted with a knit, shield etc Loosely woven textiles which are not suitable for this interior layer include a basket weave pattern.

In textile engineering, spatial occupation is a measure of fabric density (in addition to threshold ability to make a particular weave) and can be readily calculated:

Occupation=$I$=EPI×inches width/warp yarn "end"+PPI×inches width/filling yarn "pick"

Number of Ends per inch (EPI)=the warp yarns per inch in the fabric off the loom Number of Picks per inch (PPI)=weft yarns in the fabric after it has been woven "Tight" weaves generally have index values greater than about 0.90, for example, 0.91, 0.92, 0.93, 0.94, 0.95, 0.96, 0.97, 0.98, 0.99, 1.0. "Loose" weaves, like basket weaves, have values that are about 0.75 and less. Also adjustments are made to the occupation index calculation for the tightness/looseness of the weave according to the pick repeat, known as a pick repeat divisor or occupation index divisor.

Preferably, the woven interior layer in the present invention has occupation index divisors that equal or approach a value of 1.0 both for the Peirce and the Sulzer calculations. The multiplicand values should also equal or approach 1.0 in the Ruti indices.

The woven textile is ballistic resistant.

The fiber types preferred are those that are high modulus, high tensile strength. Example fibers and example commercial products (where applicable) are listed, without limitation, below. Blends or mixtures of the fibers can be used. One of skill in the art can determine a particular woven textile and component fiber to use for a particular application.

The interior layer can comprise more than one layer of woven textile, as illustrated in the Figs. One of skill in the art can determine the number of layers of woven textile to use for a particular application.

It is not necessary that every layer of woven, knit, or other conventional, ballistic resistant material be uniform in content and construction. Multiple or individual layers of various types of ballistic resistant materials can comprise the internal core materials of the total structure.

Additional Interior Layer(s)

The ballistic-resistant material can further comprise an additional layer. This layer comprises a filament wrap, resin-reinforced material. A filament wrap, resin reinforced material is any of a number of non-woven materials, for example, those produced by the processes of parallel filament lay-up without interlacings or entanglements of the composing filaments and subsequent resin encapsulation of the assemblies to produce consolidation and integrity. Products of this category include, but are not limited to, Spectra Shield®, Gold-Flex®, Dyneema UD®, Zylon® Shield, and similar products.

Example fibers and example commercial products (where applicable) are listed, without limitation, below. One of skill in the art can determine a particular non-woven material for the additional layer to use for a particular application.

This layer of filament wrap, resin-reinforced material can comprise more than one layer. One of skill in the art can determine the number of layers of woven material to use for a particular application.

The filament wrap, resin-reinforced material can provide additional ballistic resistance, especially for projectiles such as handgun ammunition.

Materials/Layers Generally

Structures made from circular, flat, v-bed, and yarn insertion weft knits could be used for some ballistic structures, and these could be substituted for one or more of the interior layers of the example embodiments illustrated.

Warp knit structures and their derivatives such as, but not limited to, Tricot system, Raschel system, weft insertion warp knits, Malimo system, Maliwaft system, and stitchbonding systems could be substituted for one or more of the interior layers of the example embodiments illustrated.

Each type of ballistic-resistant material/textile cited herein can comprise, without limitation, fibers such as [see also, e.g., Cordova et al., U.S. Pat. No. 5,343,796, herein incorporated by reference for its lists of fibers which can be useful]:

1—poly(p-phenylene terephthalamide) (Kevlar®, Twaron®, etc.) and other aramids such as poly(m-xylylene adipamide), poly(p-xylylene sebacamide), poly(2,2,2-trimethyl hexamethylene terephthalamide), poly(piperazine sebacamide), poly(metaphenylene isophthalamide) (Nomex®), poly(1,4-phenylene-2,6-benzobisoxazole) (Zylon® and any other PBO fibers), polyethylenes such as unbranched, Ultra High Molecular Weight types (Spectra®, Dyneema®, etc), poly{2,6-diimidazo[4,5-b4',5'-e]pyridinylene-1,4(2,5-dihydroxy)phenylene} (e.g., M5 fiber and other fibers with this or derived molecular structures thereof);

2—polyesters, polyolefins, polyetheramides, fluoropolymers, polyethers, celluloses, phenolics, polyesteramides, polyurethanes, epoxies, aminoplastics, silicones, polysulfones, polyetherketones, polyetheretherketones, polyesterimides, polyphenylene sulfides, polyether acryl ketones, poly(amideimides), and polyimides, aliphatic and cycloaliphatic polyamides, such as polyhexamethylene adipamide (nylon 66), poly(butyrolactam) (nylon 4), poly(9-aminonoanoic acid) (nylon 9), poly(enantholactam) (nylon 7), poly(caprylactam) (nylon 8), polycaprolactam (nylon 6), poly(p-phenylene terephthalamide), polyhexamethylene sebacamide (nylon 6,10), polyaminoundecanamide (nylon 11), polydodecanolactam (nylon 12), polyhexamethylene isophthalamide, polyhexamethylene terephthalamide, polycaproamide, poly(nonamethylene azelamide (nylon 9,9), poly(decamethylene azelamide) (nylon 10,9), poly(decamethylene sebacamide) (nylon 10,10), poly[bis-(4-aminocyclohexyl)methane 1,10-decanedicarboxamide];

3—aliphatic and aromatic polyesters such as poly(1,4-cyclohexylidene dimethyl eneterephthalate) cis and trans, poly(ethylene-1,5-naphthalate), poly(ethylene-2,6-naphthalate), poly(1,4-cyclohexane dimethylene terephthalate) (trans), poly(decamethylene terephthalate), poly(ethylene terephthalate), poly(ethylene isophthalate), poly(ethylene oxybenzoate), poly(para-hydroxy benzoate), poly(dimethylpropiolactone), poly(decamethylene adipate), poly(ethylene succinate), poly(ethylene azelate), poly(decamethylene sabacate), poly(.alpha.,.alpha.-dimethylpropiolactone), and the like.

4—Other potential candidates for fiber components are those of liquid crystalline polymers such as lyotropic liquid crystalline polymers which include polypeptides such as poly-benzyl L glutamate and the like; aromatic polyamides such as poly(1,4-benzamide), poly(chloro-1-4-phenylene terephthalamide), poly(1,4-phenylene fumaramide), poly(chloro-1,4-phenylene fumaramide), poly(4,4'-benzanilide trans, trans-muconamide), poly(1,4-phenylene mesaconamide), poly(1,4-phenylene) (trans-1,4-cyclohexylene amide), poly(chloro-1,4-phenylene) (trans-1,4-cyclohexylene amide), poly(1,4-phenylene 1,4-dimethyl-trans-1,4-cyclohexylene amide), poly(1,4-phenylene 2.5-pyridine amide), poly(chloro-1,4-phenylene 2.5-pyridine amide), poly(3,3'-dimethyl-4,4'-biphenylene 2.5 pyridine amide), poly(1,4-phenylene 4,4'-stilbene amide), poly(chloro-1,4-phenylene 4,4'-stilbene amide), poly(1,4-phenylene 4,4'-azobenzene amide), poly(4,4'-azobenzene 4,4'-azobenzene amide), poly(1,4-phenylene 4,4'-azoxybenzene amide), poly(4,4'-azobenzene 4,4'-azoxybenzene amide), poly(1,4-cyclohexylene 4,4'-azobenzene amide), poly(4,4'-azobenzene terephthal amide), poly(3,8-phenanthridinone terephthal amide), poly(4,4'-biphenylene terephthal amide), poly(4,4'-biphenylene 4,4'-bibenzo amide), poly(1,4-phenylene 4,4'-bibenzo amide), poly(1,4-phenylene 4,4'-terephenylene amide, poly(1,4-phenylene 2,6-naphthal amide), poly(1,5-amide), poly(1,4-phenylene 2,6-naphthal amide), poly(1,5-naphthalene terephthal amide), poly(3,3'-dimethyl-4,4-biphenylene terephthal amide), poly(3,3'-dimethoxy-4,4'-biphenylene terephthal amide), poly(3,3'-dimethoxy-4,4-biphenylene 4,4'-bibenzo amide) and the like; polyoxamides such as those derived from 2,2'-dimethyl-4,4'-diamino biphenyl and chloro-1,4-phenylene diamine polyhydrazides such as poly chloroterephthalic hydrazide, 2,5-pyridine dicarboxylic acid hydrazide) poly(terephthalic hydrazide), poly(terephthalicchloroterephthalic hydrazide) and the like;

poly(amidehydrazides) such as poly(terephthaloyl 1,4 aminobenzhydrazide) and those prepared from 4-aminobenzhydrazide, oxalic dihydrazide, terephthalic dihydrazide and para-aromatic diacid chlorides; polyesters such as those of the compositions include poly(oxy-trans-1,4-cyclohexyleneoxycarbonyl-trans-1,4-cyclohexylenecarbony 1-b-oxy-1,4-phenyleneoxyteraphthaloyl) and poly(oxy-cis-1,4-cyclohexyleneoxycarbonyl-trans-1,4-cyclohexylenecarbonyl-b-oxy-1,4-phenyleneoxyterephthaloyl) in methylene chloride-o-cresol poly(oxy-trans-1,4-cyclohexylene oxycarbonyl-trans-1,4-cyclohexylenecarbonyl-b-oxy-(2-methyl-1,4-phenylene) oxy-terephthaloyl) in 1,1,2,2-tetrachloroethane-o-chlorophenol-phenol, poly[oxy-trans-1,4-cyclohexyleneoxycarbonyl-trans-1,4-cyclohexylenecarbony 1-b-oxy(2-methyl-1,3-phenylene)oxy-terephthaloyl] in o-chlorophenol and the like;

polyazomethines such as those prepared from 4,4'-diaminobenzanilide and terephthalaldephide, methyl-1,4-phenylenediamine and terephthalaldehyde and the like; polyisocyanides such as poly(.alpha.-phenyl ethyl isocyanide), poly (n-octyl isocyanide) and the like; polyisocyanates such as poly(n-alkyl isocyanates) as for example poly(n-butyl isocyanate), poly(n-hexyl isocyanate) and the like; lyotropic crystalline polymers with heterocyclic units such as poly(1,4-phenylene-2,6-benzobisthiazole) (PBT), poly(1,4-phenylene-2,6-benzobisoxazole) (PBO), poly(1,4-phenylene-1,3,4-oxadiazole), poly(1,4-phenylene-2,6-benzobisimidazole), poly[2,5(6)-benzimidazole] (AB-PBI), poly[2,6-(1,4-phenylene-4-phenylquinoline] poly[1,1'-(4,4'-biphenylene)-6,6'-bis(4-phenylquinoline)] and the like;

copolymers of poly(ethylene terephthalate) and p-hydroxybenzoic acid; and thermotropic polyamides and thermotropic copoly(amide-esters).

Construction of the Material

The most preferred results for ballistic protection against small arms weapons such as pistols, submachine guns, and short rifles have been found to result when ballistic-resistant needled-felt is placed at the extreme front of the structure and at the extreme back of the structure. Various combinations of component materials within the interior layers of the total architecture of the fabrication are possible, for example, as shown in the alternate embodiments depicted in the Figures. However, the sequencing (order) of layers maintains the first and last components (i.e., the exterior layers of the material). Preferred embodiments are shown in the attached figures, but other structural combinations are within the scope of the invention.

The layers do not need to be attached to each other, sewn, bonded etc., thus permitting far better flexibility than with sewn or bonded layered structures; the layers can be attached when it is of greater importance for the final material structure to be a firmly consolidated armor material rather than having enhanced flexibility.

It has further been discovered that reduced thickness and improved ballistic benefit can be achieved by removal of air from the non-woven ballistic textile. Preferably, the air removal is done prior to assembly with the other layer(s).

Two example techniques for achieving this air removal have been found particularly advantageous. One method is roller compression by unheated, parallel, squeezing rolls, through which the non-woven is processed after fiber assembly and/or after consolidation of the assembly. The other technique is pulling a vacuum on the non-woven fabrics after fiber assembly and/or after fiber consolidation. The vacuum technique removes the air from the fiber sheet and reduces its thickness to increase fiber density in the final structure. The two compression and density increasing techniques can be used in combination or independently of each other, depending on the sensitivity of the constituent fibers to compression loading during processing. One of skill in the art can determine a suitable technique for removing the air from the material.

Increased ballistic resistance benefits in the range of 10%-15% have been observed in tests at both civilian and military laboratory tests as a result of application of compression to the non-woven textiles where no other variables were present.

Application of other treatments such as water resistant and/or flame resistant coatings are optionally also included as part of the material construction, and these may be applied at any stage prior to the compression treatments described above. One of skill in the art can determine a treatment suitable or desirable for a particular end use of the ballistic-resistant material.

Articles

The invention also includes articles made from the ballistic-resistant material. For example, garments or equipment can be made from the material. Examples of garments include vests, helmets, body armor, and the like. Examples of equipment include shielding, coverings, shrouds, and the like.

One of skill in the art can make the articles using existing methods for working with ballistic-resistant materials.

EXAMPLES

Example 1

Performance Testinq

Materials and Methods:

ArmorFelt® and 840 denier Twaron® (tightly woven aramid fabric) were layered into samples according to Table 1. Table 1 indicates whether each sample had sewn layers as indicated at the top of the columns and by the sewing dimensions column.

The assembled samples were weighed and subjected to ballistics testing in accordance with U.S. Dept. of Justice standard testing using NIJ 101.03 and 0101.04 test protocols for body armor.

Results of this experiment are shown in Table 1.

This testing also revealed that the conventional practice of fastening layers together by means of sewing is not necessary when multilayered sandwich material construction is used.

TABLE 1

Performance data.

| Sewing Dims. | ArmorFelt ® Layers Front | 840 Den Twaron ® Layers Diamond Sewn | 840 Den Twaron ® Layers Square Sewn | 840 Den Twaron ® Layers Unsewn | Total Layers 840 Den Twaron ® |
|---|---|---|---|---|---|
| None | 2 | 0 | 0 | 22 | 22 |
| None | 0 | 0 | 0 | 22 | 22 |
| 1.25" | 2 | 11 | 11 | 0 | 22 |

TABLE 1-continued

Performance data.

| | | | | | |
|---|---|---|---|---|---|
| 2" | 2 | 11 | 11 | 0 | 22 |
| 3" | 2 | 11 | 11 | 0 | 22 |
| 3" | 0 | 11 | 11 | 0 | 22 |
| None | 2 | 0 | 0 | 22 | 22 |
| None | 2 | 2 Unsewn Twaron ® | 28 Unsewn Spectra ® Shield | 2 Unsewn Twaron ® | 32 Twaron ® + Spectra ® |
| 1.25" | 2 | 11 | 11 | 0 | 22 |
| 2" | 2 | 11 | 11 | 0 | 22 |
| Current Vest | 36 KM2 Kevlar | | | | |

| Sewing Dims. | Oz./Ft$^2$ | ArmorFelt ® Layers Back | Total Layers ArmorFelt ® | Oz./Ft$^2$ | Total Oz./Ft$^2$ | Velocity Ft/sec | Result* | Backface Deformation |
|---|---|---|---|---|---|---|---|---|
| None | 12.67 | 4 | 6 | 5.34 | 18.01 | 1458.00 | 8 | 32 |
| None | 12.67 | 6 | 6 | 5.34 | 18.01 | 1478.00 | C | Failed |
| 1.25" | 12.67 | 4 | 6 | 5.34 | 18.01 | 1441.00 | 11 | 32 |
| 2" | 12.67 | 4 | 6 | 5.34 | 18.01 | 1454.00 | 11 | 30 |
| 3" | 12.67 | 4 | 6 | 5.34 | 18.01 | 1483.00 | 9 | 26 |
| 3" | 12.67 | 6 | 6 | 5.34 | 18.01 | 1454.00 | C | Failed |
| None | 12.67 | 4 | 6 | 5.34 | 18.01 | 1722.00 | P | 48 |
| None | 16.68 | 4 | 6 | 5.34 | 22.02 | 1756.00 | P | 28 |
| 1.25" | 12.67 | 4 | 6 | 5.34 | 18.01 | 1446.00 | 2 | 44 |
| 2" | 12.67 | 4 | 6 | 5.34 | 18.01 | 1495.00 | P | Not recorded |
| Current Vest | 27.20 | | | | 27.20 | | P | |

% weight improvement over current vest = 33.78
9 mm, 124 grain, full metal jacket standard = 1461.33 ft/sec
.44 Magnum, 240 grain, SJHP standard = 1470.50
*C = complete penetration;
P = partial penetration;
# = number of layers penetrated before stop.

Example 2

Design Testing

Materials and Methods:

High density Twaron® (tightly woven aramid fabric)

Low density Twaron® (tightly woven aramid fabric)

ArmorFelt®

ArmorFelt® and high density and low density Twaron® were layered into samples according to Table 2. Table 2 indicates whether each sample had sewn layers. Also tested was a conventional 36 KM2 Kevlar® sample.

The assembled samples were weighed and subjected to ballistics testing in accordance with U.S. Dept. of Justice standard testing using NIJ 101.03 and 0101.04 test protocols for body armor.

Results of this experiment are shown in Table 2. % improvement indicates improvement in weight over the conventional sample.

TABLE 2

Results of initial design testing.

| Sewn (or fixed)? | Hi Density Twaron ® Layers | Oz./Ft2 | Lo Density Twaron ® Layers | Oz./Ft2 | ArmorFelt ® Layers | Oz./Ft2 | Total Oz./Ft2 | Result* | % Improvement |
|---|---|---|---|---|---|---|---|---|---|
| yes | 18 | 12.18 | 0 | 0 | 4 | 2.30 | 14.49 | C | |
| yes | 0 | 0.00 | 18 | 10.368 | 4 | 2.30 | 12.67 | P | 53.41176471 |
| no | 0 | 0.00 | 18 | 10.368 | 4 | 2.30 | 12.67 | C | |
| no | 0 | 0.00 | 20 | 11.52 | 6 | 3.46 | 14.98 | C | |
| no | 0 | 0.00 | 22 | 12.672 | 6 | 3.46 | 16.13 | C | |
| no | 0 | 0.00 | 24 | 13.824 | 8 | 4.61 | 18.43 | 24 | 32.23529412 |
| yes | 18 | 12.18 | 0 | 0 | 6 | 3.46 | 15.64 | C | |
| yes | 24 | 16.24 | 0 | 0 | 6 | 3.46 | 19.70 | C | |
| yes | 9 | 6.09 | 15 | 8.64 | 6 | 3.46 | 18.19 | 23 | 33.13529412 |
| yes | 0 | 0.00 | 20 | 11.52 | 6 | 3.46 | 14.98 | 9 | 44.94117647 |
| yes | 0 | 0.00 | 20 | 11.52 | 4 | 2.30 | 13.82 | 12 | 49.17647059 |
| no | 0 | 0.00 | 18 | 10.368 | 6 | 3.46 | 13.82 | C | |
| no | 0 | 0.00 | 20 | 11.52 | 6 | 3.46 | 14.98 | C | |
| yes | 0 | 0.00 | 22 | 12.672 | 6 | 3.46 | 16.13 | 7 | 40.70588235 |
| yes | 36 KM2 Kevlar | 27.20 | | | | | 27.20 | P | |

Example 3

Ballistic Testing

One very difficult U.S. military standard for body armor is the required ballistic resistance against 2 grain fragment protection at 3300 feet per second.

Ballistic testing was conducted in accordance with the specifications of U.S. Army Air Warrior test protocol described in PD 614200 section 4.4.4.1.

In the testing conducted, all layered ballistic material designs passed the 2 grain fragment test. The recommended military standard woven aramid design failed the test.

Style results were as follows:

50 layers 3512 Twaron® (tightly woven aramid fabric) textile (V50=3318)

1 layer blended, needled nonwoven textile (ArmorFelt®), 44 layers woven aramid textile (3512), 2 blended, needled nonwoven textile (ArmorFelt®)

(V50=3328)

2 layers blended, needled nonwoven textile (ArmorFelt®), 41 layers style 3512 Twaron® (plain woven para-aramid filament fabric) textile, 3 layers blended, needled nonwoven textile (ArmorFelt®)

(V50=3316)

Baseline, or current military standard, 36 layers woven aramid (KM2 style 705)

(V50=3293)

Figure 7:
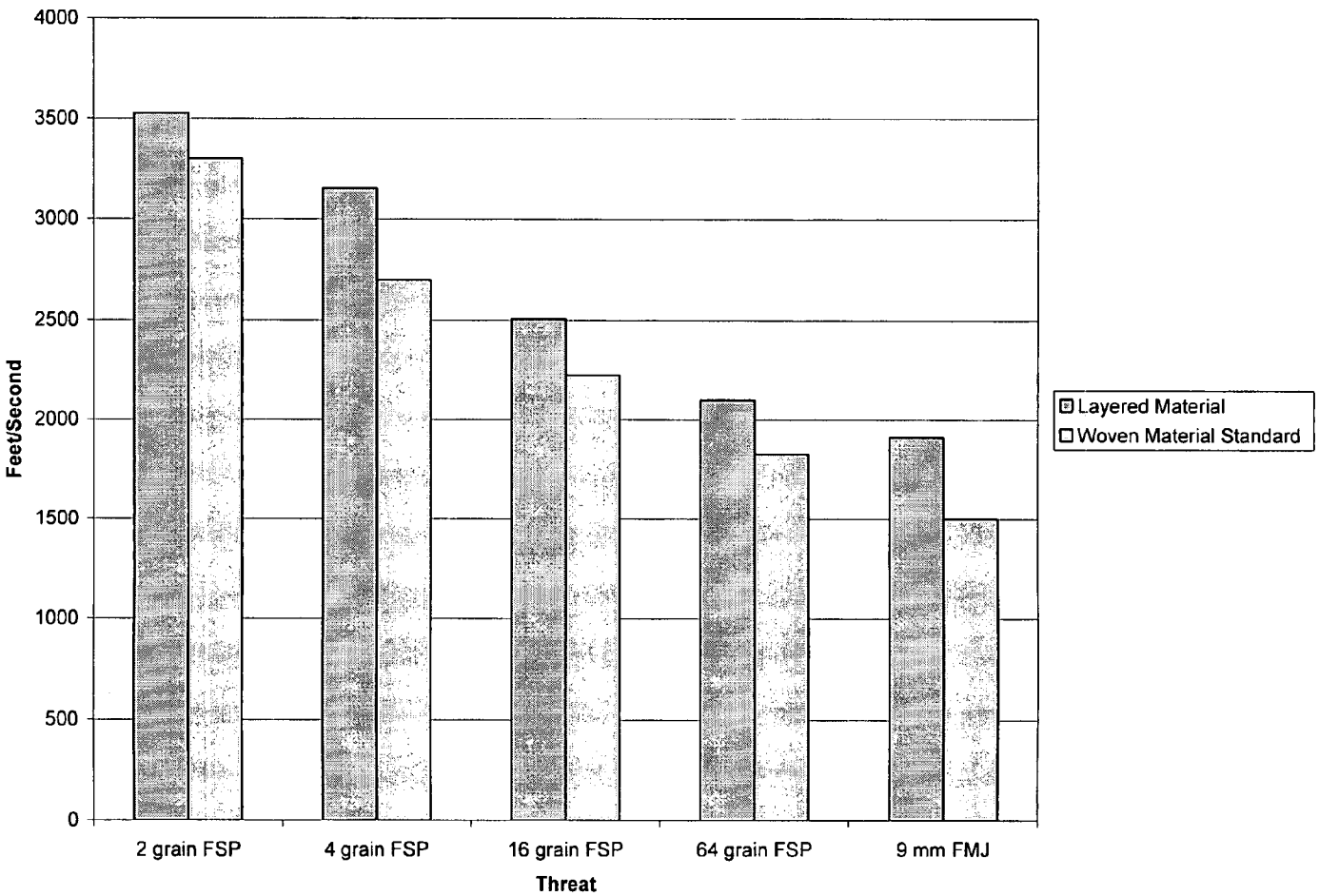
FIG. 7 shows the results of V50 testing of a multilayered material of the invention compared to a conventional woven material standard; see Example 3.

FIG. 7 shows the results of V50 testing the multilayered material compared to the conventional woven material.

in the Final Design Chosen Based on Weight, Ballistic Resistance, and flexibility criteria, the multilayered, ballistic resistant material design exceeded conventional woven aramid in all the selection categories.

In this case, the conventional woven material weighed 1.7 pounds per square foot. The layered sandwich material of the present invention weighed 1.58 pounds per square foot.

Ballistic testing of a vest for military standards was performed using a chosen embodiment of the multilayered ballistic resistant material. The vest had an insert of 2 layers ArmorFelt®, 42 layers Style 3512 Twaron®, and 2 layers ArmorFelt®. The insert weighed 25.3 ounces/square foot.

Ballistic testing was conducted in accordance with the specifications of U.S. Army Air Warrior test protocol described in PD 614200 section 4.4.4.1.

In each of the V50 test results, 3 groupings of data are shown on the graphs. The groupings represent the closest symmetrical results of complete penetrations (C) and partial penetrations (P) (a partial penetration can also be called a projectile stop). The line on the graphs indicates the V50 specification for each threat category. The designation "RCC" stands for right circular cylinder and "FSP" stands for fragment simulating projectile; the fragment simulators are made of steel.

Figure 8:
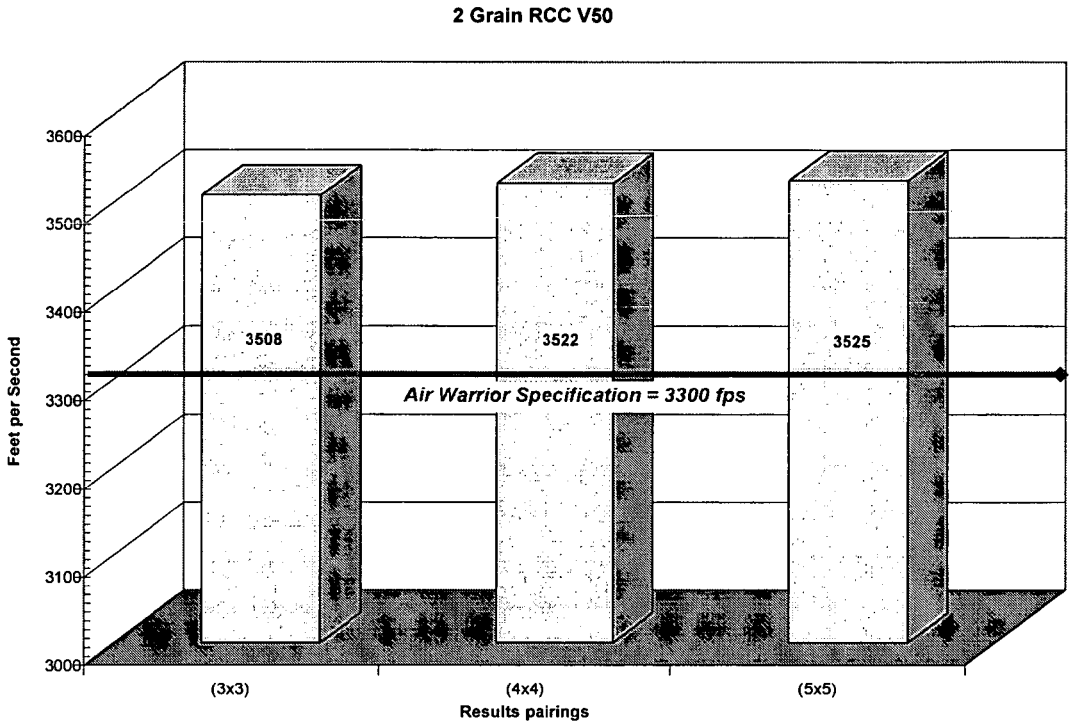
FIG. 8 shows the results of V50 testing of a multilayered material of the invention for two grain RCC fragment simulator in Example 3.

Two Grain RCC:

Results of testing with the 2 grain fragment simulator indicated that the invention prototype insert far exceeded the specification with 208 to 225 feet per second margin of safety respective of groupings. See FIG. 8.

Figure 9:
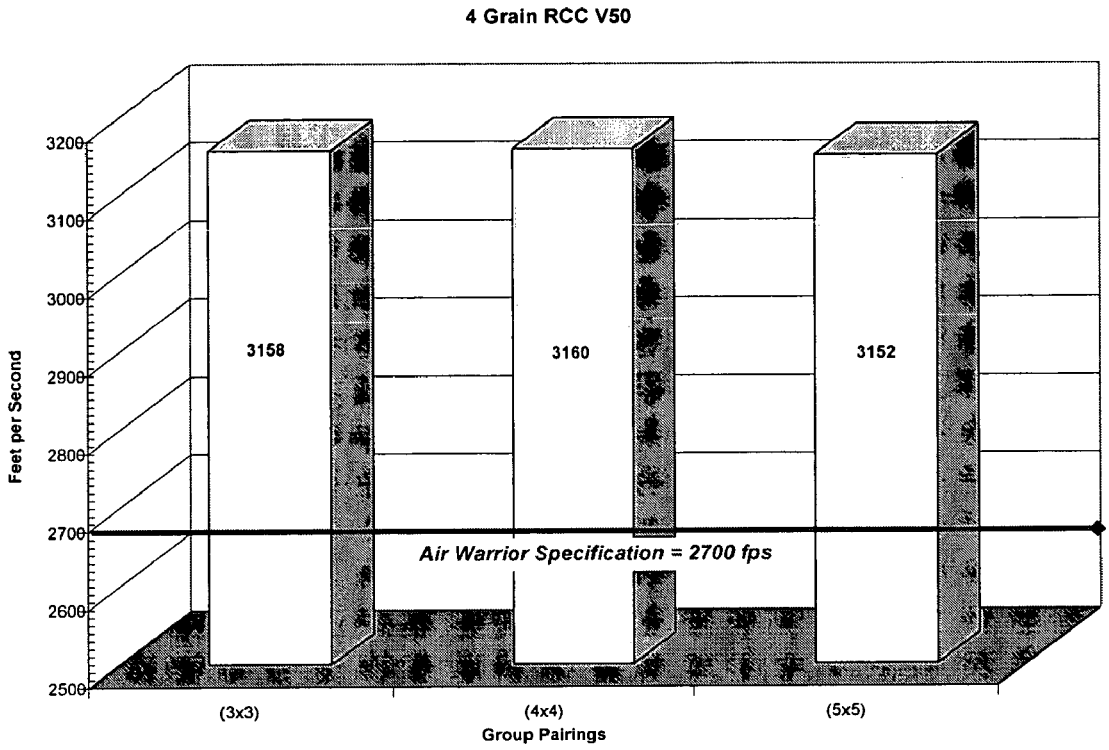
FIG. 9 shows the results of V50 testing of a multilayered material of the invention for four grain RCC fragment simulator in Example 3.

Four Grain RCC:

Results of testing with the 4 grain fragment simulator indicated that the invention prototype insert far exceeded the specification with 452 to 460 feet per second margin of safety respective of groupings. See FIG. 9.

Sixteen Grain RCC

Figure 10:
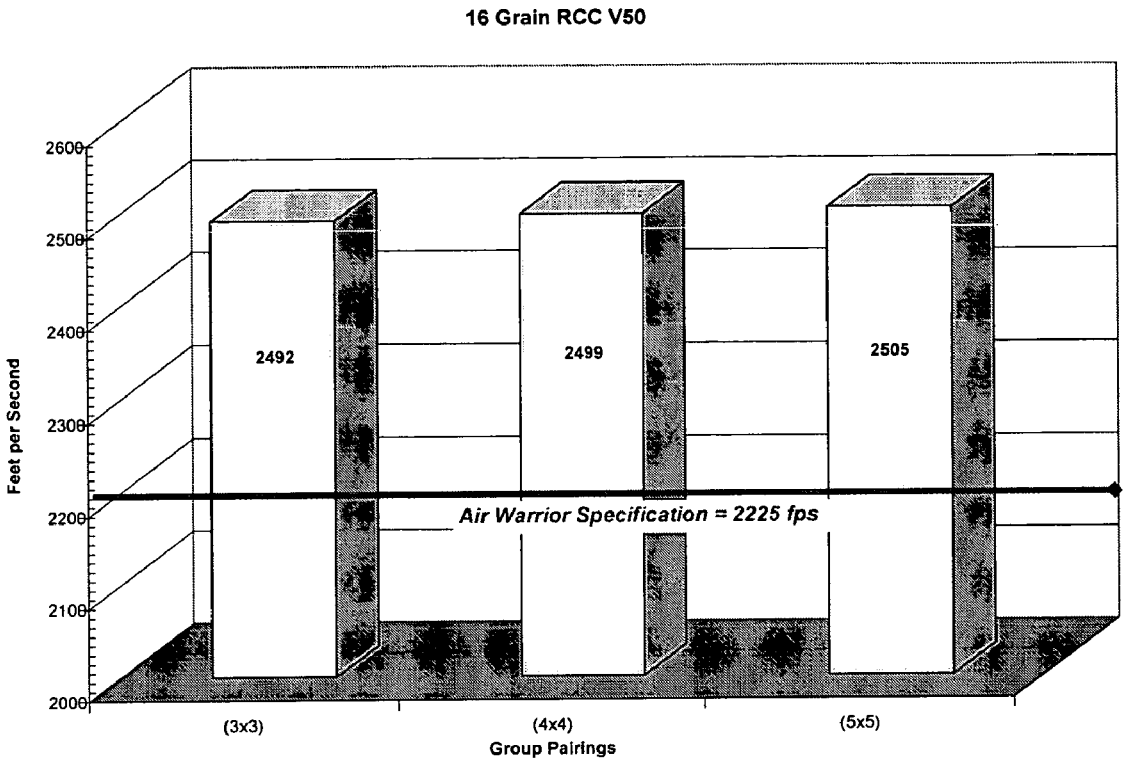
FIG. 10 shows the results of V50 testing of a multilayered material of the invention for sixteen grain RCC fragment simulator in Example 3.

Results of testing with the 16 grain fragment simulator indicated that the invention prototype insert far exceeded the specification with 267 to 280 feet per second margin of safety respective of groupings. See FIG. 10.

Sixty-Four Grain RCC

Figure 11:
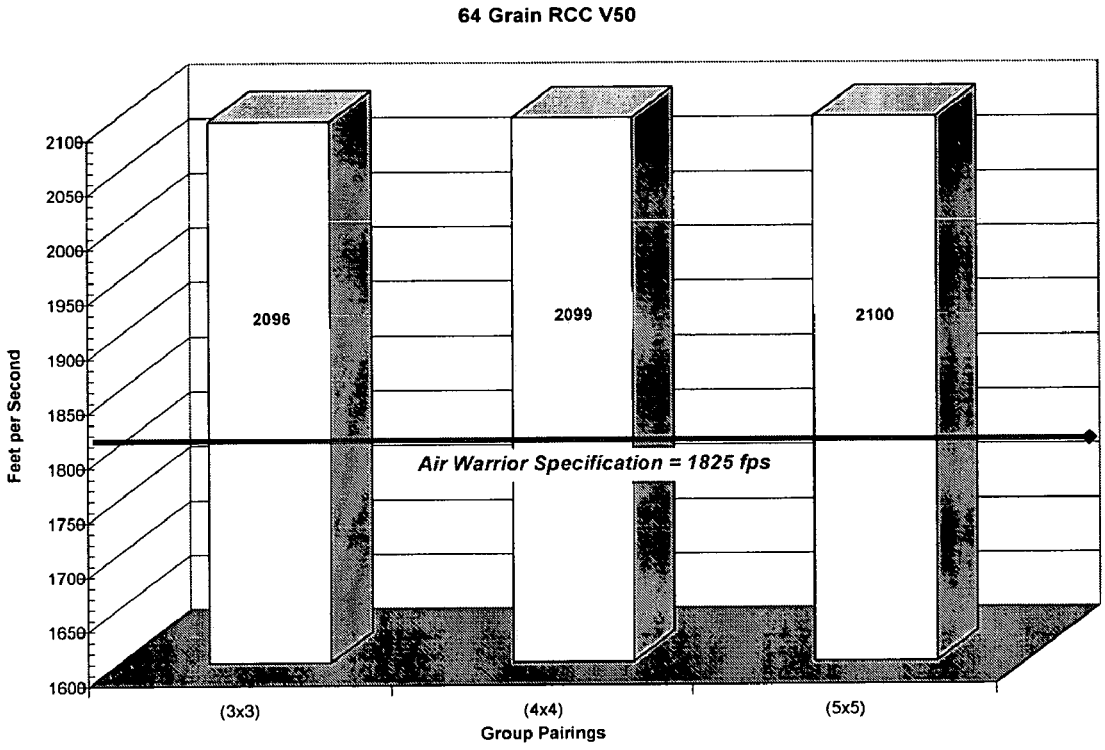
FIG. 11 shows the results of V50 testing of a multilayered material of the invention for sixty-four grain RCC fragment simulator in Example 3.

Results of testing with the 64 grain fragment simulator indicated that the invention prototype insert far exceeded the specification with 271 to 275 feet per second margin of safety respective of groupings. See FIG. 11.

Nine Millimeter FMJ

Figure 12:
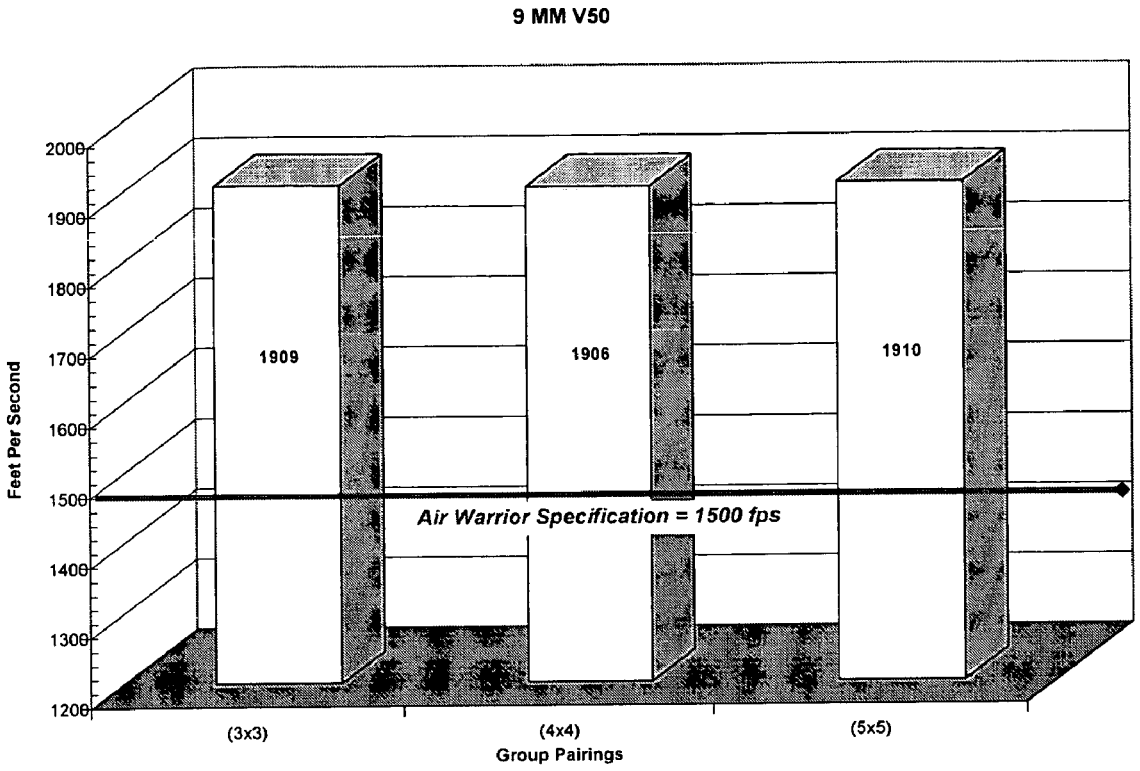
FIG. 12 shows the results of V50 testing of a multilayered material of the invention for 9 mm, one hundred twenty-four grain full metal jacket projectile in Example 3.
Figure 13:
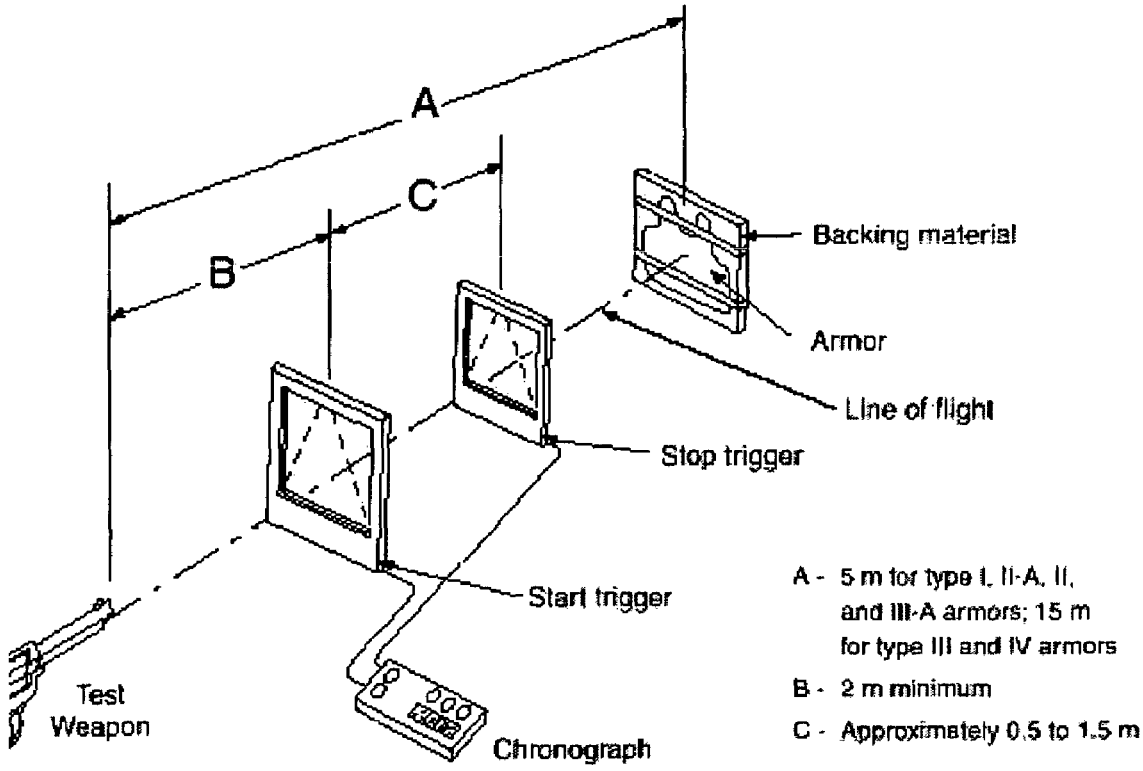
FIG. 13 shows the ballistic test setup from the National Institute of Justice (NIJ) standard 0101.03.

Results of testing with the 9 mm, 124 grain full metal jacket projectile indicated that the invention prototype insert far exceeded the specification with 406 to 410 feet per second margin of safety respective of groupings. See FIG. 12.

TABLE 3

Comparative Improvement.

| Threat | Multistructure sample result | U.S. Military Standard result | % weight/performance improvement |
|---|---|---|---|
| 2 grain | 3525 | 3300 | 7.33 |
| 4 grain | 3152 | 2700 | 18.00 |
| 16 grain | 2505 | 2225 | 13.53 |
| 64 grain | 2100 | 1825 | 16.20 |
| 9 mm | 1910 | 1500 | 29.39 |
| Oz/ft$^2$ | 25.3 | 27.2 | |

Example 4

Field Tests

A standard, NIJ Level II rated (Table 4) body armor vest was enhanced as previously described with two layers of the ArmorFelt® (50% para-aramid, 50% ECPE) on each side of the vest. Multiple test shots from a Level III-A, 9 mm rifle firing a 124 grain, FMJ projectile at 1460-1500 feet/second were unable to penetrate the enhanced vest. When the ArmorFelt® enhancement was removed from the standard body armor vest, the same type of 9 mm projectiles delivered from the same test weapon easily and completely penetrated the vest.

TABLE 4

NIJ standards for Ballistic Resistance.

| Threat Level | Caliber | Projectile Description | Weight (grains) | Velocity (ft/sec) |
|---|---|---|---|---|
| I | .22 long rifle | Lead | 40 | 1080 |
| I | .380 ACP | Full metal jacket | 95 | 1055 |
| II-A | 9 mm | Full metal jacket | 124 | 1120 |
| II-A | .40 S&W | Full metal jacket | 180 | 1055 |
| II | 9 mm | Full metal jacket | 124 | 1205 |
| II | .357 magnum | Jacketed soft point | 158 | 1430 |
| III-A | 9 mm | Full metal jacket | 124 | 1430 |
| III-A | .44 magnum | Jacketed soft point | 240 | 1430 |
| III | 7.62 mm NATO | Full metal jacket | 148 | 2780 |
| IV | .30-06 | Armor piercing | 166 | 2880 |

While the invention has been described with reference to preferred and example embodiments, it will be understood by those skilled in the art that a number of modifications, additions and deletions are within the scope of the invention, as defined by the following claims.

What is claimed is:

1. A multilayered ballistic-resistant material comprising a) a first exterior layer of a first ballistic-resistant nonwoven textile, b) a second exterior layer of a second ballistic-resistant non-woven textile, and c) an interior layer of a ballistic-resistant woven textile arranged between the first exterior layer and the second exterior layer, wherein the woven textile is a tight weave at the technical jamming point of fabric construction.

2. The multilayered ballistic-resistant material of claim 1, wherein the woven textile is a high occupation, high fabric density woven textile.

3. The multilayered ballistic-resistant material of claim 1, wherein the woven textile has an occupation index of greater than about 0.90.

4. The multilayered ballistic-resistant material of claim 1, wherein the woven textile has an occupation index of greater than about 0.80.

5. The multilayered ballistic-resistant material of claim 1, further comprising a layer of filament wrap, resin-reinforced material arranged between the first exterior layer and the second exterior layer.

6. The multilayered ballistic-resistant material of claim 1, wherein air is removed from the non-woven textile(s) prior to assembly with the additional layers.

7. The multilayered ballistic-resistant material of claim 1, wherein the first ballistic-resistant non-woven textile and the second ballistic-resistant non-woven textile are the same.

8. The multilayered ballistic-resistant material of claim 1, wherein the first ballistic-resistant non-woven textile and the second ballistic-resistant non-woven textile are different.

9. The multilayered ballistic-resistant material of claim 1, wherein the ballistic-resistant non-woven textile is felt.

10. The multilayered ballistic-resistant material of claim 1, wherein the ballistic-resistant woven textile has occupation index divisors that equal or approach a value of 1.0 both for the Pierce and the Sulzer calculations.

11. The multilayered ballistic-resistant material of claim 1, wherein the ballistic-resistant woven textile has multiplicand values equal to or approaching 1.0 in the Rüti indices.

12. The multilayered ballistic-resistant material of claim 1, wherein the ballistic-resistant woven textile is plain weave, twill, or satin weave.

13. The multilayered ballistic-resistant material of claim 1, wherein the ballistic-resistant non-woven textile comprises poly(p-phenylene terephthalamide), ultrahigh molecular weight polyethylene, poly(1,4-phenylene-2,6-benzobisoxazole), or a blend thereof.

14. The multilayered ballistic-resistant material of claim 1, wherein the ballistic-resistant woven textile is poly(p-phenylene terephthalamide).

15. The multilayered ballistic-resistant material of claim 1, further comprising additional layers of ballistic-resistant non-woven textile.

16. The multilayered ballistic-resistant material of claim 1, further comprising additional interior layers of ballistic-resistant woven textile.

17. The multilayered ballistic-resistant material of claim 1, wherein at least two of the layers are attached together.

18. The multilayered ballistic-resistant material of claim 17, wherein at least two of the layers are sewn together.

19. A garment comprising the multilayered ballistic-resistant material of claim 1.

20. A ballistic-resistant material comprising:

a first exterior layer comprising a ballistic-resistant felt;

a second exterior layer comprising a ballistic-resistant felt; and an interior layer arranged between the first exterior layer and the second exterior layer, the interior layer comprising a high occupation, high fabric density, ballistic-resistant woven textile, wherein the woven textile is a tight weave at the technical jamming point of fabric construction.

21. The multilayered ballistic-resistant material of claim 20 wherein the ballistic-resistant non-woven textile comprises poly(p-phenylene terephthalamide), ultrahigh molecular weight polyethylene, poly(1,4-phenylene-2,6-benzobisoxazole), or a blend thereof.

22. A ballistic-resistant material comprising:

a first exterior layer comprising a non-woven ballistic-resistant textile;

a second exterior layer comprising a non-woven ballistic-resistant textile;

an interior layer arranged between the first exterior layer and the second exterior layer, said interior layer comprising a tight-weave ballistic woven textile at the technical jamming point of fabric construction; and a layer of filament wrap, resin-reinforced textile arranged between the interior layer and one of the exterior layers.

23. A multilayered ballistic-resistant material comprising a) a first exterior layer of a first ballistic-resistant non-woven textile, b) a second exterior layer of a second ballistic-resistant non-woven textile, c) an interior layer of a ballistic-resistant woven textile arranged between the first exterior layer and the second exterior layer, wherein the woven textile is a high occupation, high fabric density tight-weave ballistic woven textile, and d) a layer of filament wrap, resin-reinforced material arranged between the first exterior layer and the second exterior layer.

24. A multilayered ballistic-resistant material comprising:

a. a first exterior layer of a first ballistic-resistant non-woven textile;

b. a second exterior layer of a second ballistic-resistant non-woven textile; and c. an interior layer of a ballistic-resistant woven textile arranged between the first exterior layer and the second exterior layer, characterized in that the woven textile is a high occupation, high fabric density tightly woven textile with occupation index divisors that equal a value of 1.0, wherein the woven textile is a tight weave at the technical jamming point of fabric construction.

* * * * *